US005223386A

United States Patent [19]

Kita et al.

[11] Patent Number: 5,223,386

[45] Date of Patent: Jun. 29, 1993

[54] CYAN COUPLER

[75] Inventors: Hiroshi Kita; Shuji Kida; Yutaka Kaneko, all of Hino, Japan

[73] Assignee: Konica Corporation, Tokyo, Japan

[21] Appl. No.: 753,438

[22] Filed: Aug. 30, 1991

Related U.S. Application Data

[63] Continuation-in-part of Ser. No. 484,710, Feb. 26, 1990, abandoned.

[30] Foreign Application Priority Data

Mar. 4, 1989 [JP] Japan ..... 1-52267
Apr. 19, 1989 [JP] Japan ..... 1-97456

[51] Int. Cl.[5] ..... G03C 7/32; G03C 7/38
[52] U.S. Cl. ..... 430/558; 430/543
[58] Field of Search ..... 430/558, 558 A, 543, 430/384, 385

[56] References Cited

U.S. PATENT DOCUMENTS

| | | | |
|---|---|---|---|
| 2,186,719 | 1/1940 | Frohlich et al. | 430/558 |
| 2,362,519 | 11/1944 | Woodward | 430/384 |
| 2,389,575 | 11/1945 | Kirby et al. | 430/543 |
| 2,394,527 | 2/1946 | Woodward | 430/558 |
| 2,486,440 | 11/1949 | Schmidt et al. | 430/467 |
| 2,569,906 | 10/1951 | Starke, Jr. | 430/543 |
| 3,245,795 | 4/1966 | Gaspar | 430/376 |
| 3,304,182 | 2/1967 | Frohlich | 430/558 |
| 4,171,220 | 10/1979 | Vetter et al. | 430/222 |

FOREIGN PATENT DOCUMENTS

| | | | |
|---|---|---|---|
| 452162 | 10/1948 | Canada | 430/543 |
| 0093556 | 11/1983 | European Pat. Off. . | |
| 2371711 | 6/1978 | France . | |
| 0144130 | 9/1980 | German Democratic Rep. | 430/543 |
| 1311597 | 3/1973 | United Kingdom . | |

OTHER PUBLICATIONS

"The Theory of the Photographic Process", 3rd Edition, 1966 Mees and James, p. 387.

*Primary Examiner*—Lee C. Wright

*Attorney, Agent, or Firm*—Frishauf, Holtz, Goodman & Woodward

[57] ABSTRACT

There are disclosed a novel cyan dye-forming coupler and a silver halide photographic light-sensitive material containing the novel coupler represented by the following Formulas I to V:

Formula I

Formula II

Formula III

Formula IV (Abstract continued on next page.)

-continued

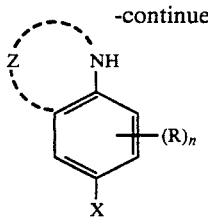

Formula V wherein R represents a substituent; Y represents a substituent having a Hammett's substituent constant $\sigma p$ of not less than 0.3 and not more than 1.5; Z represents the group of atoms necessary to form a 5 to 7-membered nitrogen-containing heterocyclic ring; l, m and n are the integers of 0 to 4, 0 to 5 and 0 to 3, respectively; and X represents a hydrogen atom or a substituent capable of splitting off upon a reaction with an oxidation product of a developing agent.

7 Claims, No Drawings

CYAN COUPLER

This is a continuation-in-part of application Ser. No. 07/484,710 filed Feb. 26, 1990, now abandoned.

FIELD OF THE INVENTION

The present invention relates to a novel photographic coupler which is used as a color photographic component material, and more particularly to a photographic coupler for the formation of a dye image having an excellent fastness against heat, moisture and light.

BACKGROUND OF THE INVENTION

Where an exposed silver halide photographic light-sensitive material is processed in a color developer, an oxidation product of a color developing agent reacts with a dye-forming coupler to produce a dye, whereby a color image is formed.

In the photographic method, color reproduction is generally carried out by a subtractive color process to form a color image composed of yellow, magenta and cyan dyes.

A photographic coupler used for the formation of a yellow dye image includes acylacetanilide couplers; a magenta color image-forming coupler includes pyrazolone, pyrazolobenzimidazole, pyrazolotriazole and indazolone couplers; and cyan color image-forming coupler includes phenol and naphthol couplers.

Dye images formed by these couplers are requested to cause no fading and discoloration even when exposed to light over a long period of time and stored under high temperature/moisture conditions.

However, the phenol and naphthol couplers that have so far been used for the formation of cyan dyes still have the insufficient spectral absorption characteristics and heat, moisture and light resistances of the dye image formed therefrom. To improve the characteristics of a cyan dye image, various attempts including introduction of substituents have been made to date, but no compounds having wholly improved characteristics are yet available.

BACKGROUND OF THE INVENTION

The cyan couplers which are normally used in silver halide color photographic light-sensitive materials are based on phenol and 1-naphthol skeletons. Their action mechanism is schematized in Scheme 1 below. In the first step, the coupler must have its proton (H+) eliminated therefrom by the hydroxyl ion (OH−) in the developer to become a coupler anion. In other words, the color photographic coupler must always be acidic to such extent that it is somewhat capable of dissociation at the pH of the developer. In ordinary cyan couplers, the 1-position OH group functions as a dissociation group to play that role.

Scheme 1

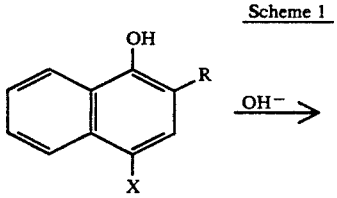

-continued

Scheme 1

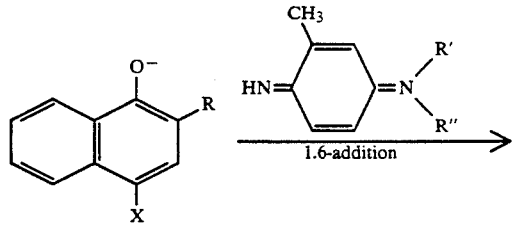

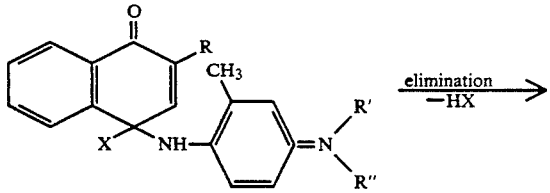

Leuco Dye

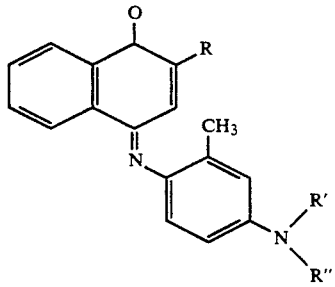

Cyan Dye

On the other hand, the dissociation group of the magenta coupler having a pyrazolo-[5,1-c]-triazole nucleus is the 1-position amino group (NH), as shown in Scheme 2. The amino group is usually basic, but it is known to be acidic when it is substituted with an electron attracting group (e.g., sulfonamide, represented by —NH-$SO_2R$) or when it is present in an aromatic ring of the $10\pi$ or $6\pi$ electron system such as pyrazolo-[5,1-c]-triazole, pyrazole, 1,3,5-triazole or imidazole.

Scheme 2

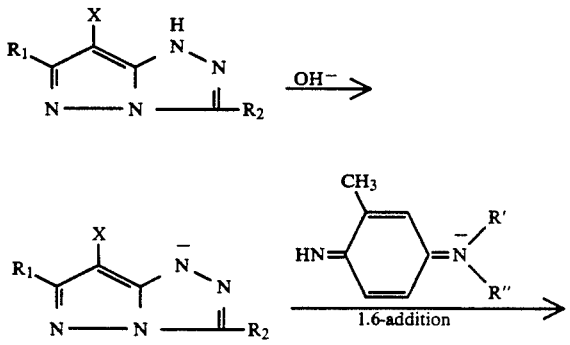

-continued

Scheme 2

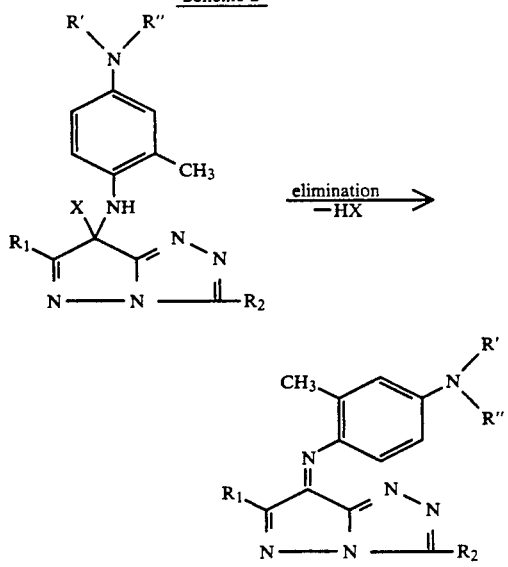

Magenta Dye

All photographic couplers have the structure of "skeleton+dissociation group". None of the photographic couplers known so far has a combination of a skeleton of benzene nucleus or naphthalene nucleus and an acidic amino group as a dissociation group. A coupler structurally similar to such couplers is the 1,5-diaminonaphthalene derivative described in East German Patent No. 144130 (L), but the substituents for its 1- and 5-position amino groups are a hydrogen atom or alkyl group or aryl group. In this case, the amino groups are considered basic and do not yield a coupler anion at the pH of the developer. In addition, the color developing process described in Examples of that patent is totally different from the ordinary color developing process in that it is carried out in hydrochloric acid in the presence of potassium bichromate. It is therefore evident that this coupler is not an ordinary color photographic coupler.

U.S. Pat. No. 2,569,906 (D) and Canadian Patent No. 452,162 (M) describe couplers based on 3-sulfonamidoaniline or 3-sulfonamide-1-naphthylamine derivative. However, the substituent which has substituted the 3-position amino group of these compounds (the group represented by Z in page 2 of the specification for Canadian Patent No. 452,162) is a leaving group which splits off upon coupling with a p-phenylenediamine based color developing agent to form an azine ring, which is thus equivalent to X in the compound of the present invention and bears no relation to the invention.

U.S. Pat. Nos. 2,389,575 (A), 2,394,527 (C) and 2,362,519 (B) describe couplers wherein the amino group of 1-naphthylamine has been substituted with a substituted alkyl group or other substituent, but these couplers develop almost no color upon ordinary color development because of the extremely low dissociating capability of the proton of the 1-position NH.

Meanwhile, the phenolic and 1-naphtholic couplers which are commonly used as photographic cyan couplers are not satisfactory with respect to the spectral absorption property, heat stability, moisture resistance, light resistance and other properties of the cyan dye images formed thereby. With the aim of improving these properties, various means have been proposed, including those associated with substituents, but no compounds have yet been obtained which meet all these requirements.

With this background, the present inventors made further investigations to solve the problems and succeeded in obtaining a stable dye image which is not liable to hue deterioration upon exposure to heat, humidity or light by the use of a new cyan coupler having a novel nucleus, and thus developed the present invention.

As stated above, this cyan coupler is structurally characterized in that the NH of the amino group acts as a dissociation group. In addition, the dissociating capability of the proton has been improved by substituting this amino group with an electron attracting group or condensing it with the benzene nucleus at the 2-position or with the naphthalene nucleus at the 2- and 8-positions to form a condensed ring and introducing an electron attracting group such as a carbonyl or sulfonyl group or an electron attracting unit such as —C=N—,

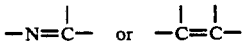

into the resulting condensed ring unit, whereby the coupling activity has been increased significantly.

SUMMARY OF THE INVENTION

It is an object of the present invention to provide a novel photographic coupler which is used as a color photographic component material.

The other object is to provide a photographic coupler used for the formation of a cyan dye image that undergoes no discoloration attributable to heat, moisture and light.

The above objects of the invention is accomplished by photographic couplers represented by the following Formulas I

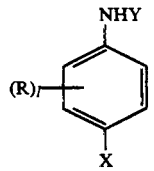

Formula I

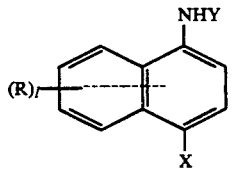

Formula II

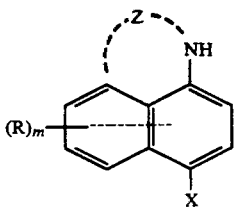

Formula III

-continued

Formula IV

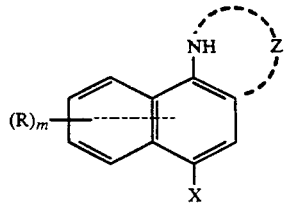

Formula V

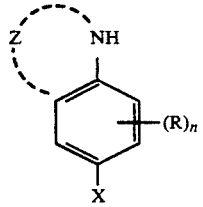

wherein R represents a substituent; l is an integer of zero to 4; m is an integer of zero to 5; n is an integer of zero to 3, provided that when l, m or n is 2 or more, R's may be the same or different; Y is a substituent whose Hammett's substituent constant $\sigma p$ is not less than 0.3 and not more than 1.5; Z is a group of atoms necessary to form a 5- to 7-member nitrogen-containing heterocyclic ring; and X is a hydrogen atom or a substituent which splits off upon reaction with an oxidation product of a color developing agent.

In Formulas I through V, the substituent represented by R includes an alkyl group, an aryl group, an anilino group, an acylamino group, a sulfonamido group, an alkylthio group, an arylthio group, an alkenyl group, a cycloalkyl group, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, a sulfonyloxy group, an aryloxy group, a heterocyclic-oxy group, a siloxy group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a heterocyclic-thio group, a thioureido group, a carboxyl group, a hydroxy group, a mercapto group, a nitro group, a sulfonic acid group, a spiro compound residue and a bridged hydrocarbon compound residue.

In the above substituents, the alkyl group has preferably 1 to 32 carbon atoms.

The aryl group is preferably phenyl.

The acylamino group is preferably an alkylcarbonyl amino or arylcarbonylamino group.

The sulfonamido group is preferably an alkylsulfonylamino or arylsulfonylamino group.

The alkyl and aryl components of the alkylthio and arylthio groups are the above alkyl and aryl groups.

The alkenyl group has preferably 2 to 32 carbon atoms, and the cycloalkyl group has preferably 3 to 12 carbon atoms, more preferably 5 to 7 carbon atoms.

The cycloalkenyl group has preferably 3 to 12 carbon atoms, more preferably 5 to 7 carbon atoms.

The sulfonyl group is an alkylsulfonyl or arylsulfonyl group.

The sulfinyl group is an alkylsulfinyl or arylsulfinyl group.

The phosphonyl group is an alkylphosphonyl, arylphosphonyl, alkoxyphosphonyl or aryloxyphosphonyl group.

The acyl group is an alkylcarbonyl or arylcarbonyl group.

The carbamoyl group is an alkylcarbamoyl or arylcarbamoyl group.

The sulfamoyl group is an alkylsulfamoyl or arylsulfamoyl group.

The acyloxy group is an alkylcarbonyloxy or arylcarbonyloxy group.

The carbamoyloxy group is an alkylcarbamoyloxy or arylcarbamoyloxy group.

The ureido group is an alkylureido or arylureido group.

The sulfamoylamino group is an alkylsulfamoylamino or arylsulfamoylamino group.

The heterocyclic group is preferably 5- to 7-member ring such as 2-furyl, 2-thienyl, 2-pyrimidinyl, 2-benzothiazolyl, 1-pyrrolyl and 1-tetrazolyl.

The heterocyclic-oxy group is preferably a 5- to 7-member ring, such as 3,4,5,6-tetrahydropyranyl-2-oxy and 1-phenyltetrazole-5-oxy.

The heterocyclic-thio group is preferably a 5- to 7-member ring such as 2-pyridylthio, 2-benzothiazolylthio and 2,4-diphenoxy-1,3,5-triazole-6-thio.

The siloxy group is trimethylsiloxy, triethylsiloxy or dimethylbutylsiloxy.

The imido group is succinic acid imido, 3-heptadecylsuccinic acid imido, phthalimido or glutarimido.

The spiro compound residue is preferably spiro[3.3-]heptane-1-yl.

The bridged hydrocarbon compound residue is bicyclo[2.2.1]heptane-1-yl, tricyclo[3.3.1.1$^{3,7}$]decane-1-yl, or 7,7-dimethylbicyclo[2.2.1]heptane-1-yl.

Preferred among the above substituents represented by R are the alkyl, aryl, carboxyl, oxycarboxyl, cyano, hydroxy, alkoxy, aryloxy, amino, amido and sulfonamido groups and halogen atom.

l is an integer of zero to 4; m is an integer of zero to 5; and n is an integer of zero to 3; provided that when l, m or n is 2 or more, R's may be either the same or different.

R's may combine with each other to form a ring, and the formed ring is preferably a 5- to 8-member ring such as a pyridine ring and a quinoline ring.

The above groups may have further a substituent of a nondiffusible group such as a long-chain hydrocarbon group and a polymer residue.

The groups represented by X are a halogen atom, an alkoxy group, an aryloxy group, a heterocyclic-oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic-thio group, an alkyloxythiocarbonylthio group, an acylamino group, a sulfonamido group, a nitrogen-containing heterocyclic group which has a reactive site at the N atom, an alkyloxycarbonylamino group, an aryloxycarbonylamino group, and a carboxyl group.

In Formulas I and II, the substituent represented by Y have the Hammett's substituent constant $\sigma p$ of not less than 0.3 and not more than 1.5, of which examples are a cyano group, a nitro group; a sulfonyl group such as octylsulfonyl, phenylsulfonyl, trifluoromethylsulfonyl and pentafluorophenylsulfonyl; a $\beta$-carboxyvinyl group; a sulfinyl group such as t-butylsulfinyl, tolylsulfinyl, trifluoromethylsulfinyl and pentafluorophenylsulfinyl; a $\beta,\beta$-dicyanovinyl group; a halogenated alkyl group such as trifluoromethyl, perfluorooctyl and $\omega$-hydroperfluorododecyl; a formyl group, a carboxyl group; a carbonyl group such as acetyl, pivaloyl, benzoyl and trifluoroacetyl; alkyl- and aryloxycarbonyl groups such as ethoxycarbonyl and phenoxycarbonyl; a 1-tetrazolyl group, a 5-chloro-1-tetrazolyl group; a carbamoyl group such as dodecylcarbamoyl and phenylcarbamoyl; and a sulfamoyl group such as trifluoromethylsulfamoyl, phenylsulfamoyl and ethylsulfamoyl.

Preferred among these groups are the cyano, sulfonyl and sulfamoyl groups.

As follows are shown the $\sigma p$ values of some substituents falling within the scope of the invention.

| Substituent | $\sigma p$ value |
|---|---|
| —CN | 0.66 |
| $-SO_2CH_3$ | 0.72 |
| $-SO_2CF_3$ | 0.93 |
| $-SO_2Ph$ | 0.70 |

Provided that the $\sigma p$ value of the substituent represented by Y in Formula II is less than 0.3, the coupler does not substantially develop color, while the $\sigma p$ value more than 1.5 makes it substantially impossible to synthesize the coupler.

In Formulas III to V, Z is preferably a group of nonmetallic atoms, and more preferably a group of nonmetallic atoms containing the following units:

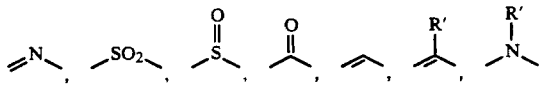

wherein R' and R'' each represent the same substituents as those represented by the foregoing R. The above units may be contained in combination.

The following are typical examples of the compounds usable in the invention:

| Cpd. No. | R | m | Y | X |
|---|---|---|---|---|
| | | | 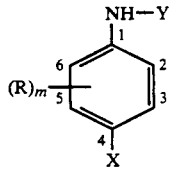 | |
| I-1 | — | 0 | —CN | —H |
| I-2 | 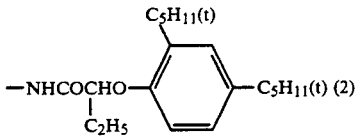 | 1 | —CN | —Cl |
| I-3 | -(t)$C_4H_9$(2), -(t)$C_4H_9$(5) | 2 | —CN | —H |
| I-4 | -(t)$C_5H_{11}$(2), -(t)$C_4H_9$(5) | 2 | —CN | $-SCH_2CH_2-COOH$ |
| I-5 | -(t)$C_5H_{11}$(2), -(t)$C_4H_9$(5) | 2 | —CN | 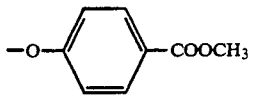 |
| I-6 | 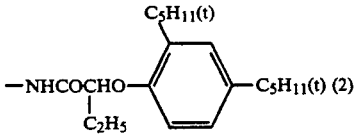 $-CH_3$(5) —Cl(5) | 3 | —CN | —Cl |
| I-7 | -(t)$C_4H_9$(2), -(t)$C_4H_9$(5) | 2 | $-SO_2CF_3$ | —H |
| I-8 | -(t)$C_4H_9$(2), -(t)$C_4H_9$(5) | 2 | 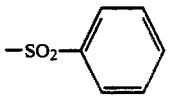 | —Cl |
| I-9 | — | 0 | $-SO_2C_{16}H_{33}$ (sec) | —H |
| I-10 | -(t)$C_5H_{11}$(2), -(t)$C_5H_{11}$(5) | 2 | $-SO_2C_{12}H_{25}$ | —H |

-continued
| Cpd. No. | R | m | Y | X |
|---|---|---|---|---|
| I-11 | -(t)$C_5H_{11}$(2), -(t)$C_5H_{11}$(5) | 2 | $-SO_2C_{12}H_{25}$ | 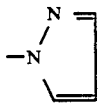 |
| I-12 | (t)$C_5H_{11}$-(2), (t)$C_5H_{11}$-(5) | 2 | $-SO_2C_{12}H_{25}$ | $-OCH_2CH_2OH$ |
| I-13 | 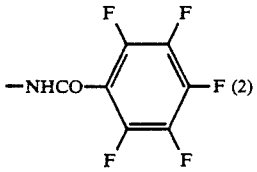 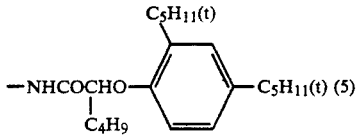 | 2 | $-SO_2C_{12}H_{25}$ | $-Cl$ |
| | 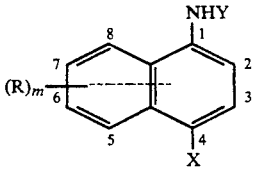 | | | |
| II-1 | — | 0 | $-CN$ | $-H$ |
| II-2 | $-NHCOC_{14}H_{29}$(5) | 1 | $-CN$ | $-H$ |
| II-3 | 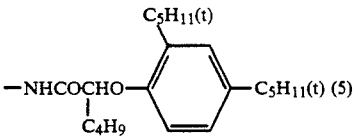 | 1 | $-CN$ | $-Cl$ |
| II-4 | $-NHCOC_{16}H_{33}$(sec) (5) | 1 | $-CN$ | $-SCH_2CH_2COOH$ |
| II-5 | $-NHCONHC_{16}H_{33}$(sec) (5) | 1 | $-CN$ | $-H$ |
| II-6 | $-NHCONHC_{16}H_{33}$(sec) (5) | 1 | $-CN$ | 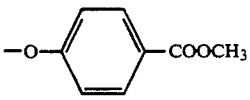 |
| II-7 | 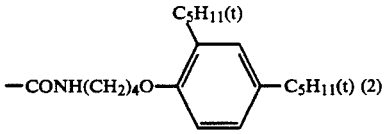 | 1 | $-CN$ | $-H$ |
| II-8 | 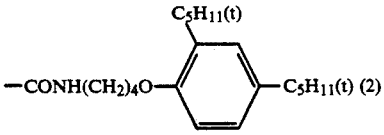 | 1 | $-CN$ | $-Cl$ |
| II-9 | $-CONHC_{16}H_{33}$(sec) (2) | 1 | $-CN$ | 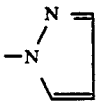 |
| II-10 | $-CONHC_8H_{17}$(t) (2)<br>$-NHCOC_{12}H_{25}$(5) | 2 | $-CN$ | $-H$ |

-continued
| Cpd. No. | R | m | Y | X |
|---|---|---|---|---|
| II-11 | 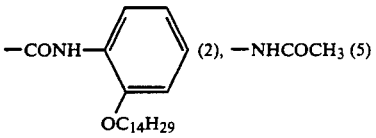 | 2 | —CN | —Cl |
| II-12 | 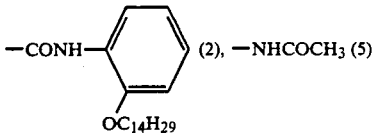 | 2 | —CN | —$SCH_2CH_2COOH$ |
| II-13 | 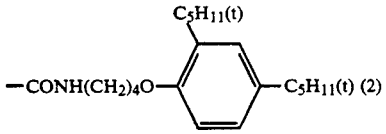 —$NHCONHC_2H_5$(5) | 2 | —CN | —Cl |
| II-14 | —$NHCOC_{16}H_{33}$(sec) (8) | 1 | —CN | —H |
| II-15 | — | 0 | —$SO_2C_{14}H_{29}$ | —H |
| II-16 | 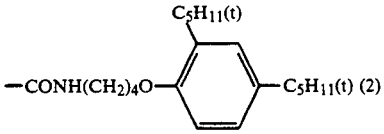 | 1 | —$SO_2CF_3$ | —H |
| II-17 | —$CONHC_{14}H_{29}$(2) | 1 | 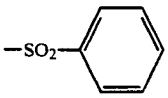 | —Cl |
| II-18 | —$CONHC_{16}H_{33}$(sec) (2) | 1 | —$SO_2CH_3$ | 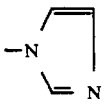 |
| II-19 | 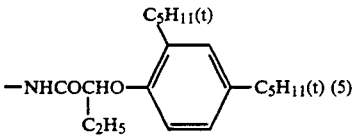 | 1 | 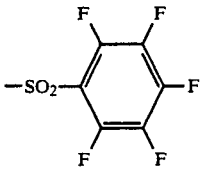 | —H |
| II-20 | 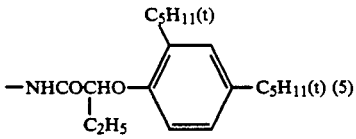 | 1 | —$SO_2CH_3$ | —Cl |
| II-21 | —$NHCOC_{14}H_{29}$(5) | 1 | —$SO_2C_4H_9$ | —$SCH_2CH_2OH$ |
| II-22 | 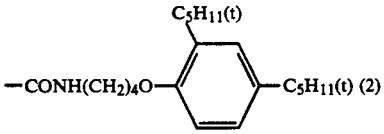 —$NHCOC_{14}H_{29}$(5) | 2 | 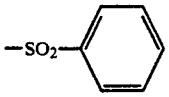 | —H |
| II-23 | 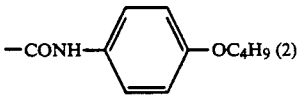 | 2 | —$SO_2CF_3$ | —$OCH_2COOH$ |

-continued
| Cpd. No. | R | m | Y | X |
|---|---|---|---|---|
| | $-NHCOC_{14}H_{29}(5)$ | | | |
| II-24 | 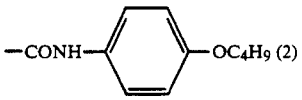 | 2 | $-SO_2C_2H_5$ | $-Cl$ |
| | $-NHCOC_{14}H_{29}(5)$ | | | |
| II-25 | $-NHCOC_{16}H_{33}(8)$ | 1 | 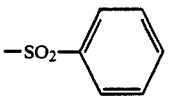 | $-H$ |
| II-26 | $-NHCOCH_3(8)$ | 1 | $-SO_2C_{14}H_{29}$ | $-Cl$ |
| II-27 | 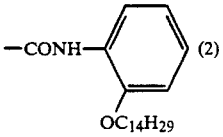 | 1 | $-SO_2NHC_2H_5$ | $-H$ |
| II-28 | $-NHCOC_{10}H_{21}(5)$ | 1 | 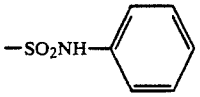 | $-Cl$ |
III-1
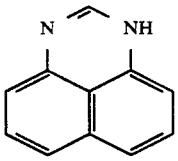
III-2
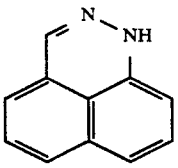
III-3
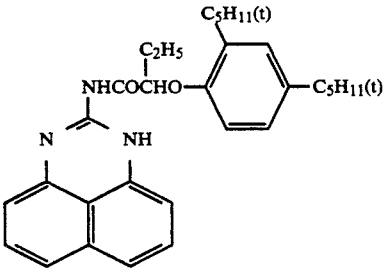
-continued
III-4
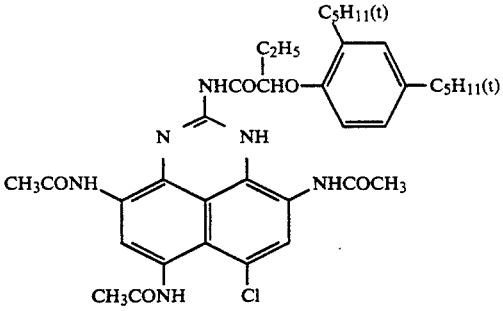
III-5
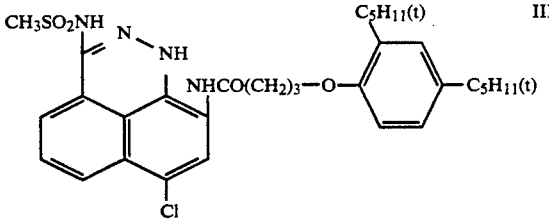
III-6
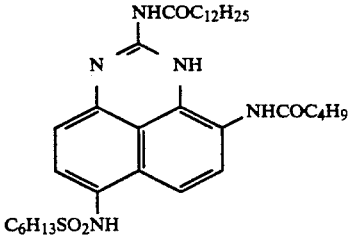

-continued
III-7
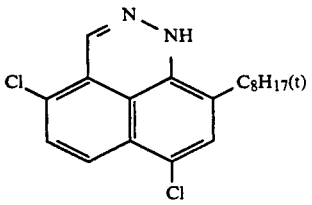
III-8
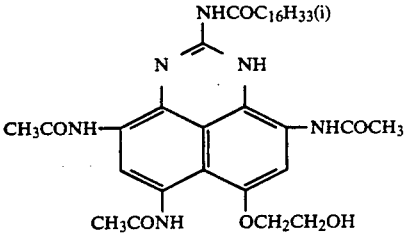
III-9
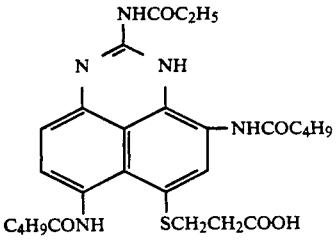
III-10
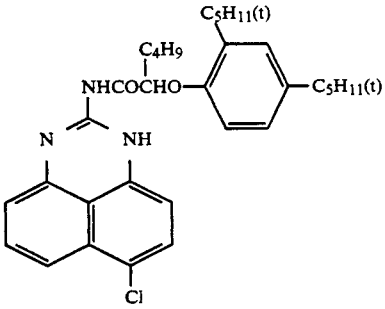
III-11
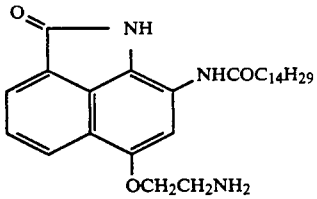
III-12
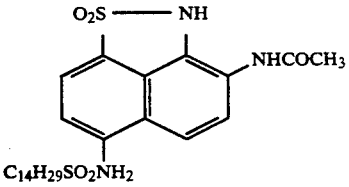
III-13
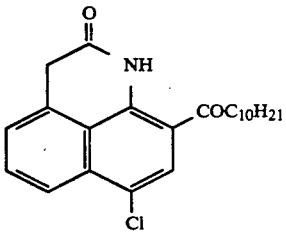
-continued
III-14
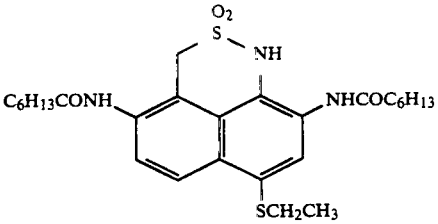
III-15
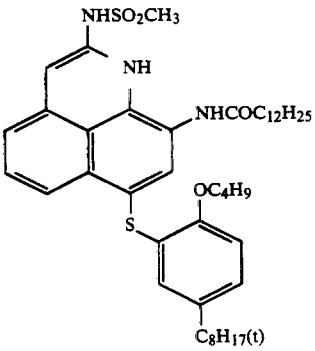
III-16
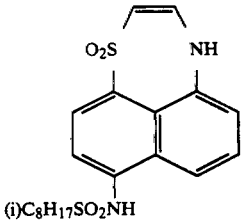
III-17
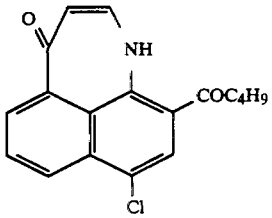
III-18
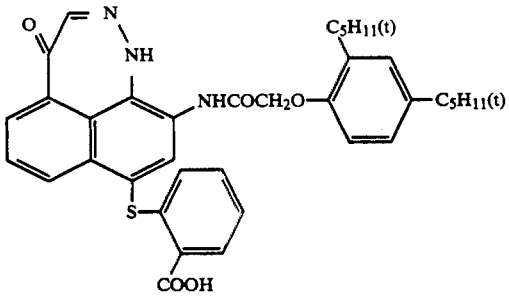
III-19
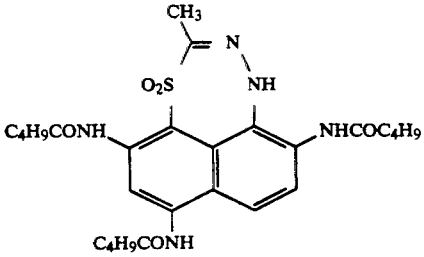

-continued
III-20
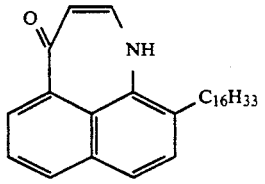
III-21
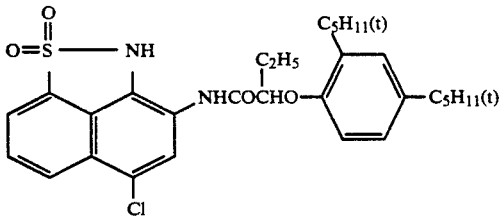
III-22
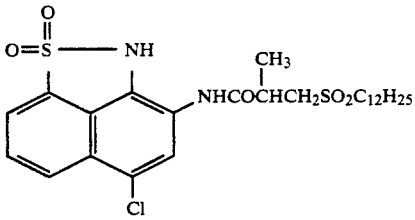
III-23
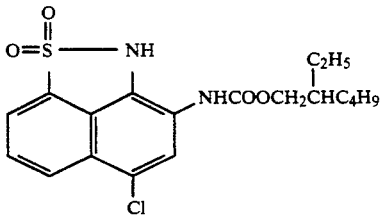
III-24
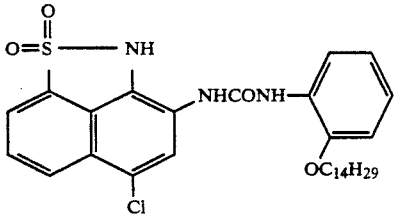
III-25
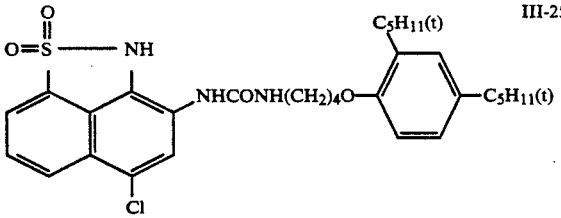
III-26
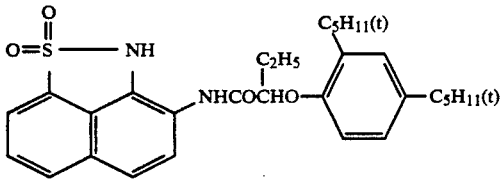
-continued
III-27
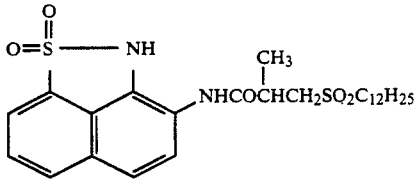
III-28
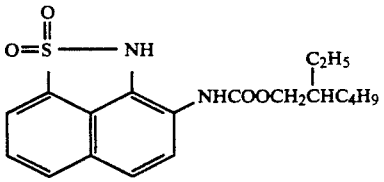
III-29
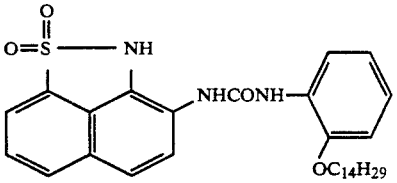
III-30
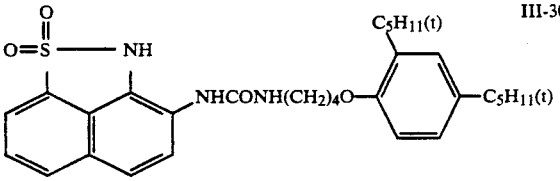
III-31
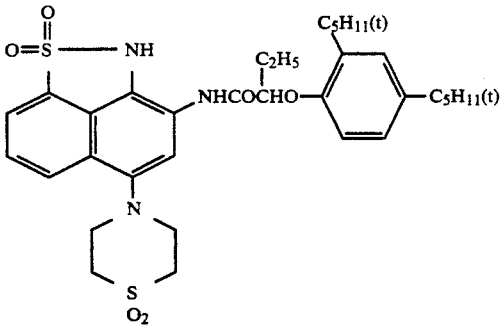
III-32
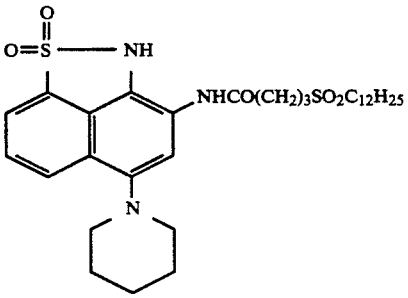

-continued
III-33
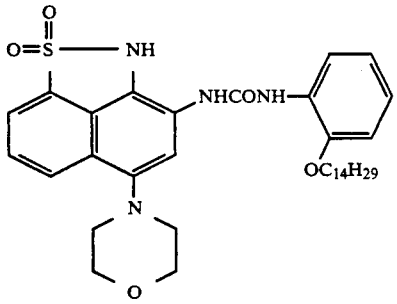
III-34
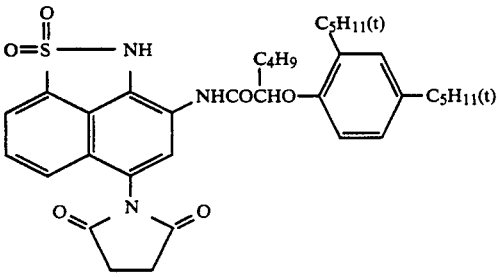
III-35
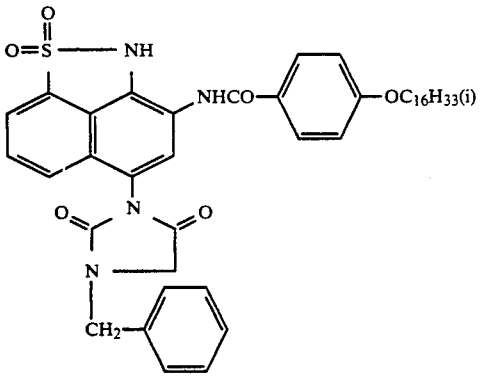
III-36
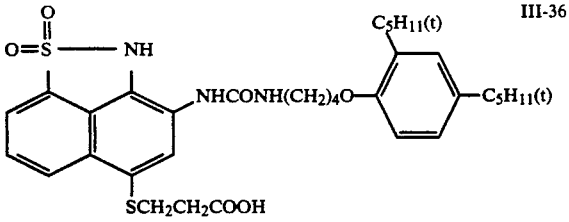
III-37
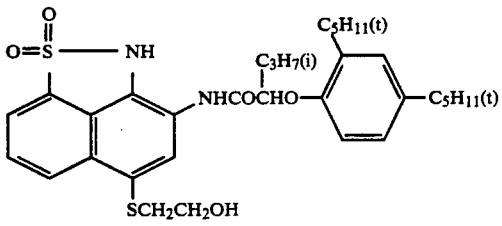
-continued
III-38
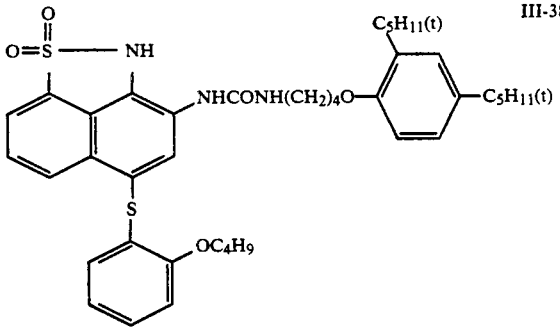
III-39
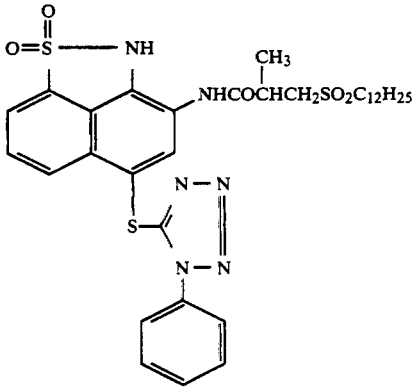
III-40
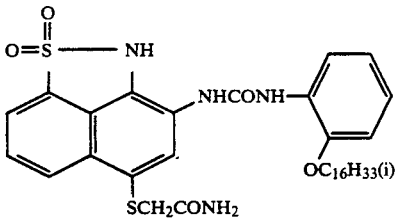
III-41
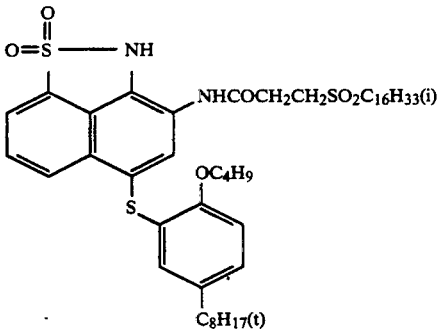
III-42
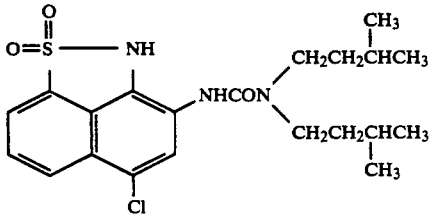

-continued
III-43
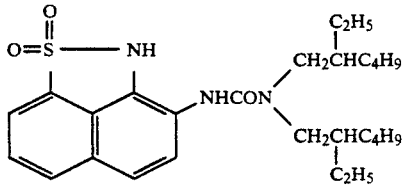
III-44
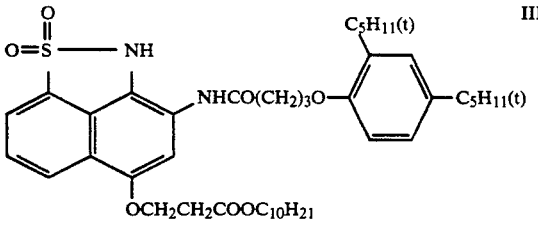
III-45
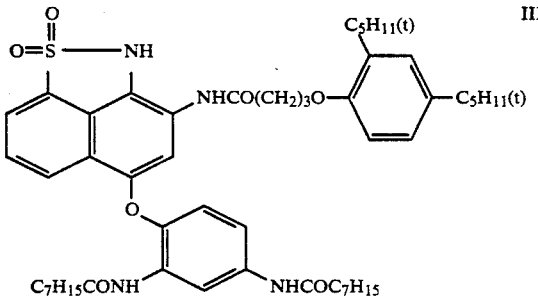
III-46
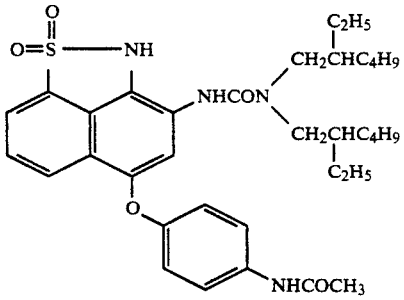
III-47
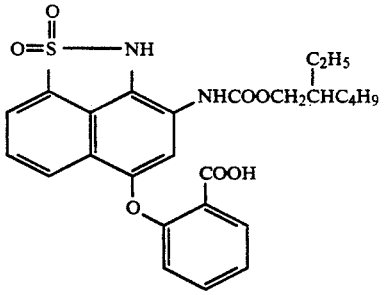
III-48
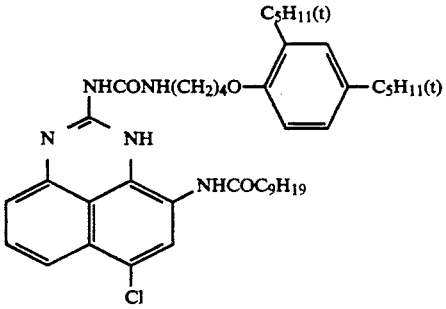
-continued
III-49
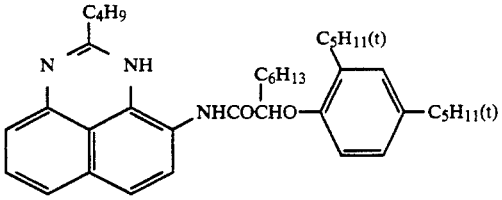
III-50
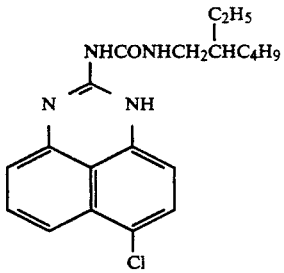
IV-1
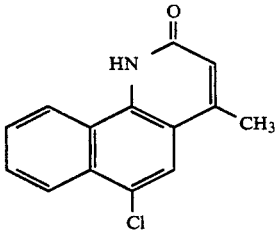
IV-2
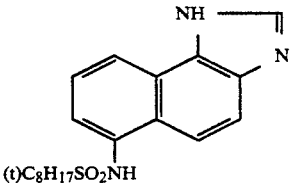
IV-3
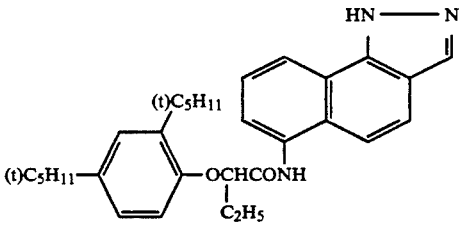
IV-4
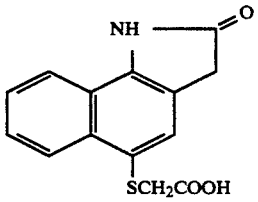
IV-5
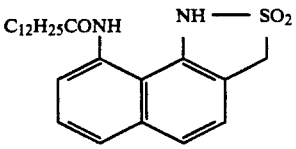

-continued
IV-6
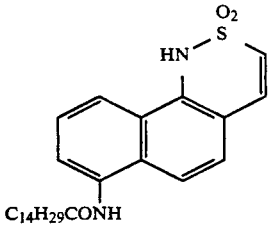
IV-7
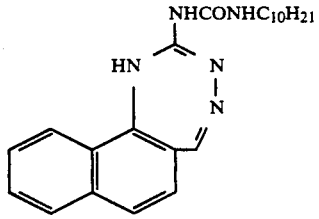
IV-8
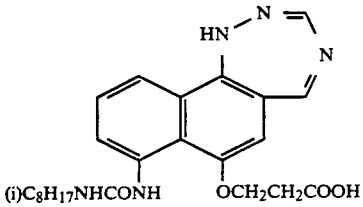
IV-9
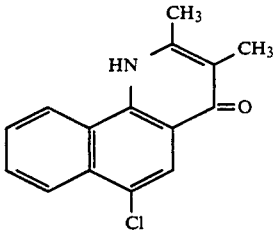
IV-10
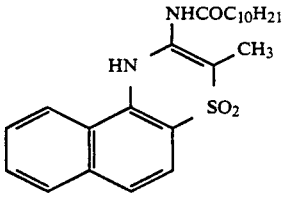
V-1
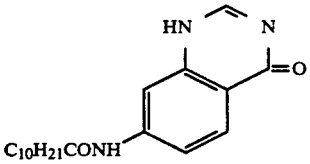
V-2
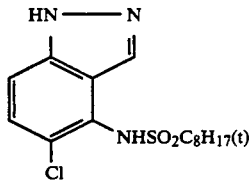
V-3
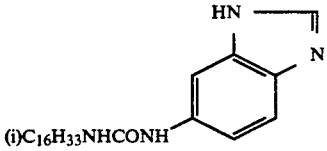
-continued
V-4
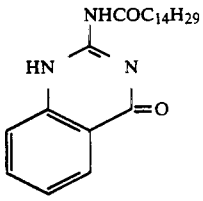
V-5
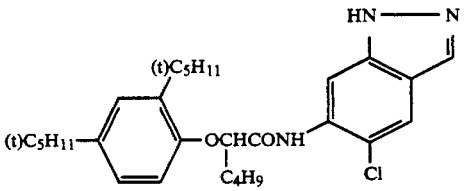
V-6
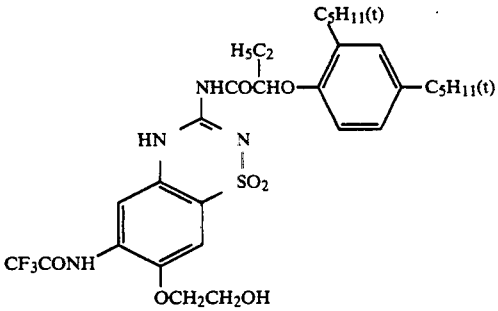
V-7
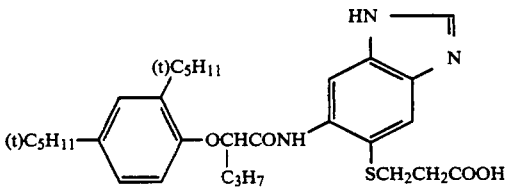
V-8
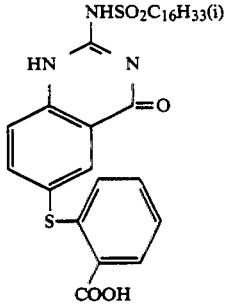
Syntheses of these couplers of the invention can be carried out in accordance with the methods described in the Organic Syntheses Collective, Vol. 4, pp. 180 and 172.
Syntheses of some of the couplers of the invention are detailed below:
Synthesis of Compound II-2:
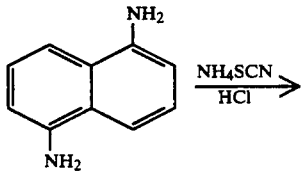
1

-continued

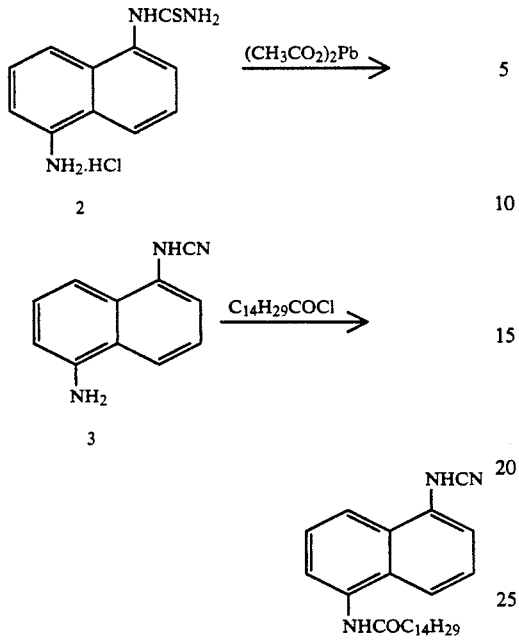

(Compound II-2)

Synthesis of intermediate 2:

There were suspended 47.5 g of 1,5-diaminonaphthalene in 300 ml of water and dissolved by adding 55 ml of 12N hydrochloric acid thereto. The solution, to which 25 g of ammonium thiocyanate were added, was heated at 80° to 90° C. with stirring for one hour. The reaction liquid was slowly concentrated to precipitate the solid, which was brayed finely in a mortar and then heated at 150° to 200° C. for 5 hours. The solid suspended in 300 ml of water was heated to 70° C. to dissolve it, and then cooled to room temperature. The precipitated solid was filtered, dried, and recrystallized in a toluene-ethanol mixture solvent, whereby 23.7 g of a white crystalline intermediate 2 were obtained, which was identified by $^1$HNMR, FD mass spectrum and IR.

Synthesis of intermediate 3:

To a suspension of 22.9 g of the intermediate 2 in 100 ml of boiled water were added a heated solution of 49.5 g of potassium hydroxide dissolved in 60 ml of water; there was added immediately a heated saturated aqueous solution of 37.7 g of lead diacetate trihydrate, and the liquid was boiled for 10 minutes. The black insoluble matter was filtered off while heating, and the filtrate was cooled to room temperature, whereby white crystals were precipitated. The crystals were filtered, washed and dried, whereby 14.3 g of an intermediate 3 were obtained, which was identified by $^1$HNMR, FD mass spectrum and IR.

Synthesis of Compound II-2:

To a suspension of 14.0 g of the intermediate 3 in 300 ml of ethyl acetate was added a solution of 7.5 g of sodium acetate dissolved in 50 ml of water, and it was cooled to 5° C. This mixture liquid, after adding dropwise thereto in about 30 minutes an ethyl acetate solution of 21.9 g of pentadecanoic acid chloride, was stirred at 5° C. for 4 hours. The reaction liquid was separated, washed three times with 200 ml of water and dried with magnesium sulfate. The solvent was distilled off under reduced pressure to obtain the solid, which was recrystallized with acetonitrile, whereby 22.1 g of white crystal, a compound II-2, was obtained, which was identified by $^1$HNMR, FD mass spectrum and IR.

Synthesis of Compound III-3:

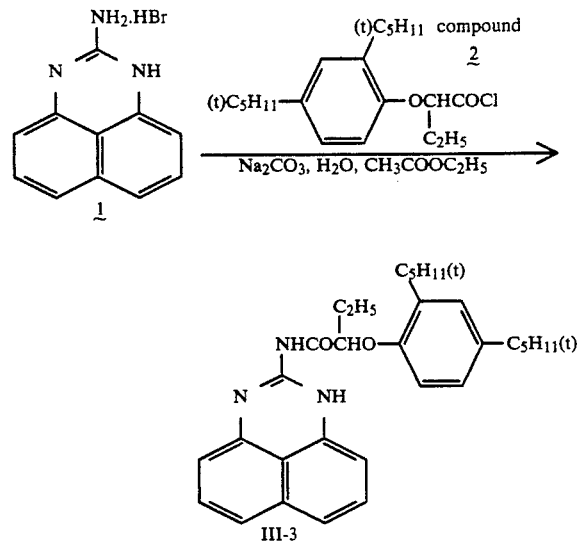

To a 500 ml aqueous solution of 20 g sodium carbonate were added 700 ml of ethyl acetate and 26.4 g of 2-aminoperimidine hydrobromide to prepare a suspension. The suspension, after adding dropwise thereto in about 30 minutes a solution of 37.3 g of a compound 2 dissolved in ethyl acetate, was stirred at room temperature for 2 hours. The reaction liquid was separated, washed three times with 500 ml of water and dried with magnesium sulfate. The solvent was distilled off under reduced pressure, and the residual yellow oily product was refined by silica gel column chromatography, whereby 29.5 g of light yellow powder III-3 were obtained, which was identified by $^1$HNMR, FD mass spectrum and IR spectrum.

Synthesis Example 1

Synthesis of Compound III-21

Route of synthesis

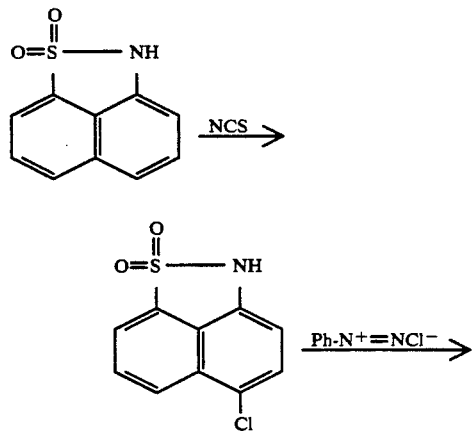

Intermediate 1

-continued

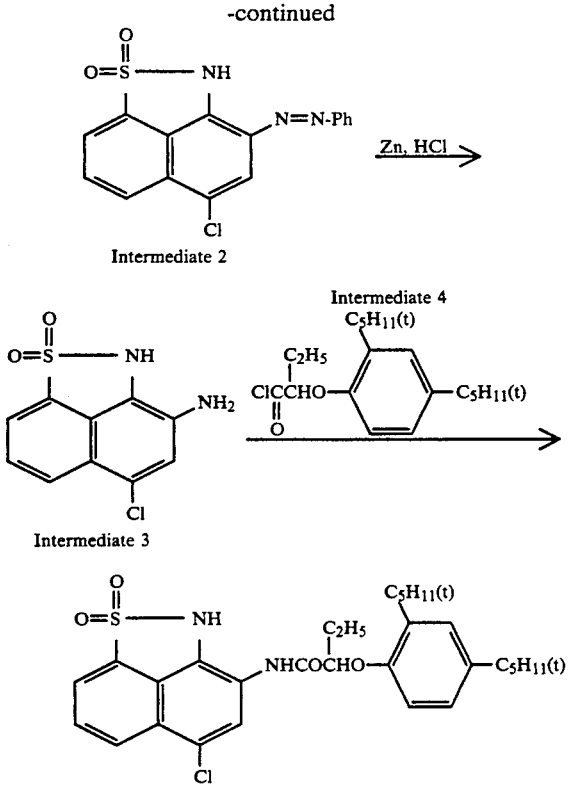

Synthesis of Intermediate 1

99.7 g of 1,8-naphthosultam was dissolved in 550 ml of tetrahydrofuran with heating. After ice-cooling the resulting solution to about 10° C., 71.4 g of N-chlorosuccinimide was added over a period of about 1 hour. After stirring the reaction solution at 10° to 12° C. for 4 hours, 200 ml of ethyl acetate and 300 ml of saturated saline were added, followed by layer separation. After three cycles of washing with 300 ml of 10% saline, the organic phase was dried over anhydrous magnesium sulfate. To this solution was added 5 g of activated charcoal, followed by stirring at 50° C. for 1 hour. Then, the activated charcoal was filtered out and the resulting filtrate was evaporated under reduced pressure to distill off the solvent. The resulting brown solid was recrystallized from ethyl acetate to yield 37.0 g of a yellow-brown crystal of Intermediate 1. Its structure was determined by $^1$H NMR, IR spectrometry and FD mass spectrometry.

Synthesis of Intermediate 2

10.7 g of aniline was dissolved in 76.7 ml of 6N hydrochloric acid. After cooling this solution to 0° C. in a cooling bath of ice and sodium chloride, 8.7 g of sodium nitrite was added little by little so that the reaction solution temperature did not exceed 5° C. to yield a solution of benzenediazonium salt.

Separately, 25.0 g of Intermediate 1 was dissolved in 20 ml of DMF. After adding 450 ml of ethanol, the solution was ice-cooled to 5° C. Then, 62.6 g of anhydrous sodium acetate was added, and the above solution of benzenediazonium salt was added dropwise over a period of about 30 minutes. After completion of the addition, the reaction solution was added to 1600 ml of water. The separating crystal was collected by filtration and thoroughly washed with water, after which it was dried to yield 34.9 g of a red crystal of Intermediate 2. Its structure was determined by $^1$H NMR, IR spectrometry and FD mass spectrometry.

Synthesis of Compound III-21

3.0 g of Intermediate 2 was suspended in 180 ml of ethyl acetate. To this suspension were added 75 ml of 1N hydrochloric acid and 6 g of powdery zinc, followed by stirring. About 15 minutes later, the red color of the dye disappeared and the solution became light yellow. This ethyl acetate solution was subjected to separating and dried over anhydrous sodium sulfate, after which the solvent was distilled off under reduced pressure. To the residue was added 15 ml of pyridine. After sparging gaseous nitrogen, 4.4 g of Intermediate 4 was added, followed by stirring with heating at 60° C. for 4 hours. After cooling the reaction solution to room temperature, the pyridine was neutralized with concentrated hydrochloric acid, followed by extraction with 100 ml of water and 100 ml of ethyl acetate. After drying the organic phase over anhydrous magnesium sulfate, the solvent was distilled off under reduced pressure to yield a brown solid, which was then re-crystallized from acetonitrile to yield 3.1 g of a light yellow crystal of Compound III-21. Its structure was determined by $^1$H NMR, IR spectrometry and FD mass spectrometry.

Synthesis Example 2

Synthesis of Compound III-25

Route of synthesis

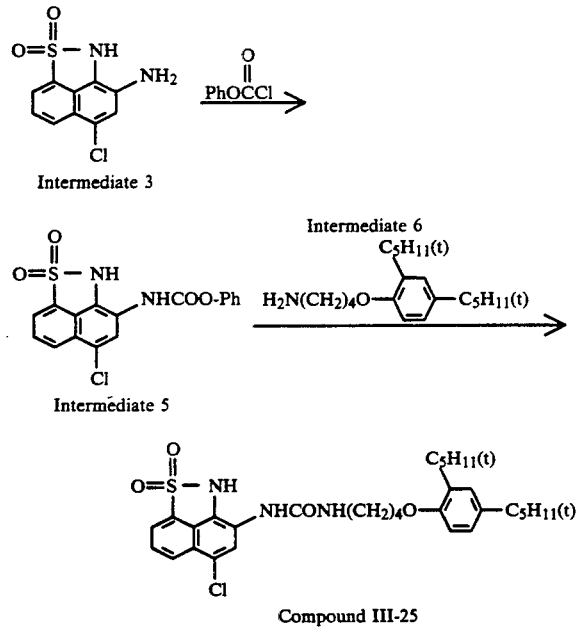

Synthesis of Intermediate 5

2.1 g of Intermediate 3 was dissolved in 50 ml of acetonitrile. After ice-cooling the resulting solution to 5° C., 1.0 ml of pyridine was added and then 1.35 g of phenyl chloroformate was added dropwise. After stirring at constant temperature for about 2 hours, the resulting crystal was collected by filtration and washed with cold acetonitrile to yield 2.0 g of a light yellow-green crystal of Intermediate 5. Its structure was determined by $^1$H NMR, IR spectrometry and FD mass spectrometry.

Synthesis of Compound III-25

To 2.0 g of Intermediate 5, 1.8 g of Intermediate 6 and 80 mg of imidazole was added 30 ml of acetonitrile, followed by refluxing with heating for 3 hours. After distilling off the acetonitrile under reduced pressure, the reaction solution was re-crystallized from an ethyl acetate/n-hexane mixed solvent to yield 2.0 g of a light yellow crystal of Compound III-25. Its structure was determined by $^1$H NMR, IR spectrometry and FD mass spectrometry.

Synthesis Example 3

Synthesis of Compound III-36

Route of synthesis

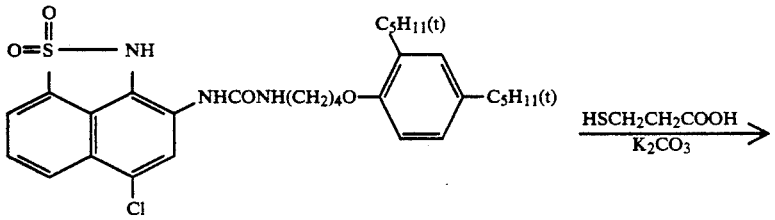

Compound III-25

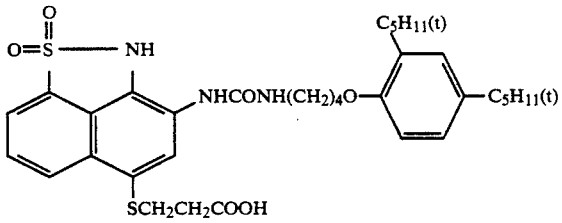

Compound III-36

Synthesis of Compound 16

To 2.0 g of Compound III-25 were added 10 ml of acetonitrile, 0.8 g of potassium carbonate and 0.5 g of β-mercaptopropionic acid, followed by refluxing with heating in nitrogen atmosphere for 6 hours. After distilling off the acetonitrile under reduced pressure, the reaction solution was separated into layers by the addition of 50 ml of ethyl acetate and 20 ml of a 0.5% aqueous solution of sodium hydrogen carbonate. Then, the organic phase was twice washed with 20 ml of saline. After drying the organic phase over anhydrous magnesium sulfate, the solvent was distilled off under reduced pressure. The resulting residue was purified by silica gel column chromatography to yield 1.2 g of a light yellow crystal of Compound III-36. Its structure was determined by $^1$H NMR, IR spectrometry and FD mass spectrometry.

Synthesis Example 4

Synthesis of Compound III-26

Route of synthesis

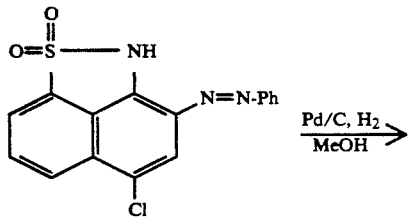

Intermediate 2

-continued

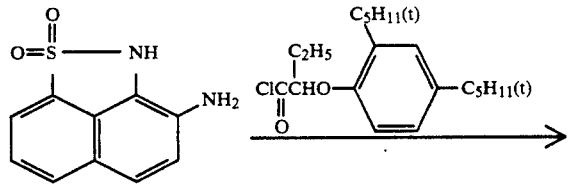

Intermediate 7

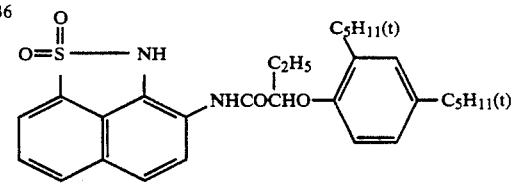

Compound III-26

Synthesis of Intermediate 7

To 10.0 g of Intermediate 2 were added 300 ml of methanol and 3.5 g of palladium/activated charcoal (ratio=10%), followed by catalytic reduction at a reaction temperature of 50° C. under a hydrogen pressure of 1 atm. About 4 hours later, when the hydrogen gas had been consumed, the reaction was stopped and the catalyst palladium/activated charcoal was filtered out. After distilling off the solvent methanol under reduced pressure to reach a volume of 150 ml, the reaction solution was kept standing overnight to yield 3.0 g of a brown crystal of Intermediate 7. Its structure was determined by $^1$H NMR, IR spectrometry and FD mass spectrometry.

Synthesis of Compound III-26

To 1.4 g of Intermediate 7 was added 10 ml of pyridine in nitrogen atmosphere and then 2.4 g of Intermediate 4, followed by stirring at room temperature for 1 hour. Then, stirring was continued with heating at a reaction temperature of 60° C. for 4 hours. After cooling the reaction solution to room temperature, the pyridine was neutralized with concentrated hydrochloric acid, followed by extraction with 50 ml of water and 50 ml of ethyl acetate. After drying the organic phase over anhydrous magnesium sulfate, the solvent was distilled off under reduced pressure. The resulting residue was re-crystallized from acetonitrile to yield 1.5 g of a light yellow crystal of Compound III-26. Its structure was determined by $^1H$ NMR, IR spectrometry and FD mass spectrometry.

Synthesis Example 5

Synthesis of Compound III-31

Route of synthesis

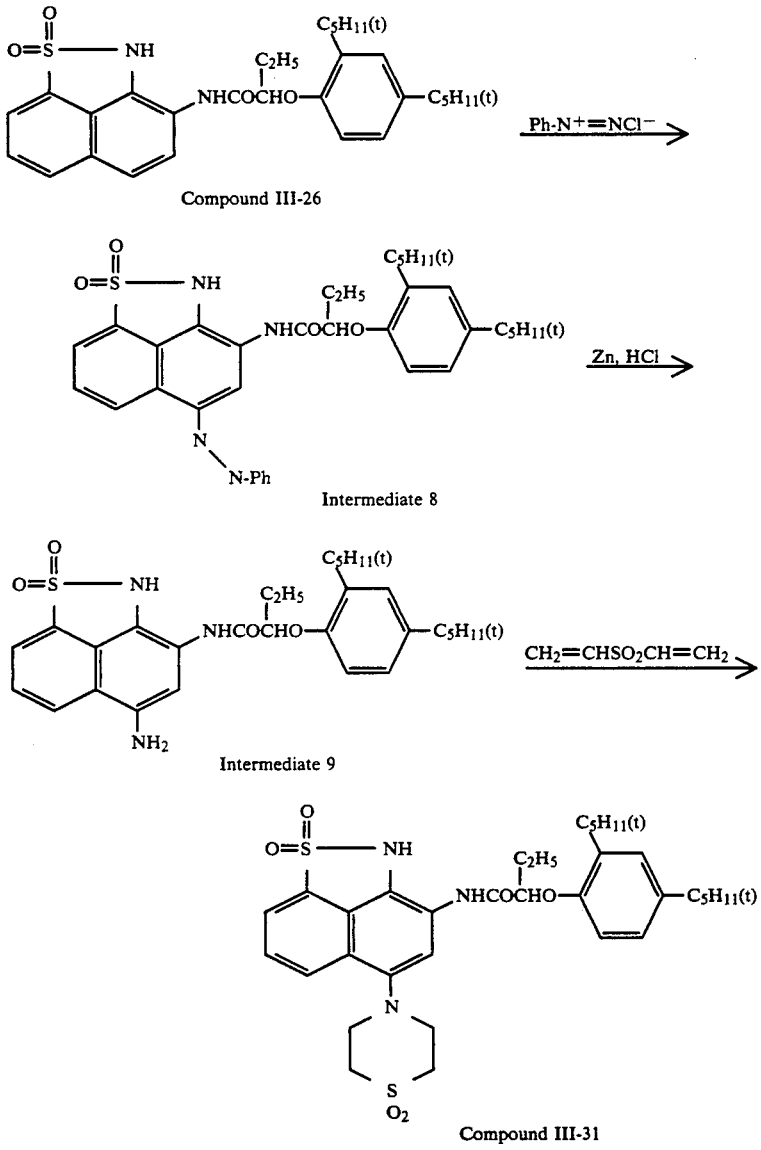

Synthesis of Intermediate 8

5.4 g of aniline was dissolved in 7.7 ml of 6N hydrochloric acid. After cooling this solution to 0° C. in a cooling bath of ice and sodium chloride, 0.9 g of sodium nitrite was added little by little so that the reaction solution temperature did not exceed 5° C. to yield a solution of benzenediazonium salt.

Separately, 5.5 g of Compound III-26 was dissolved in 20 ml of DMF. After adding 200 ml of ethanol, the solution was ice-cooled to 5° C. Then, 6.3 g of anhydrous sodium acetate was added, and the above solution of benzenediazonium salt was added dropwise so that the reaction solution temperature did not exceed 10° C. After completion of the addition, the reaction solution was added to 200 ml of water. The resulting red crystal was collected by filtration and re-crystallized from ethanol to yield 5.8 g of a red-orange crystal of Intermediate 8.

Synthesis of Compound III-31

To 5.6 g of Intermediate 8 were added 200 ml of ethyl acetate, 100 ml of 1N hydrochloric acid and 4 g of powdery zinc, followed by vigorous stirring for about 30 minutes. The organic phase was separated and then washed with 100 ml of saline and dried over anhydrous magnesium sulfate, after which the ethyl acetate was distilled off under reduced pressure. To the resulting solid were added 50 ml of 1-butanol and 1.5 g of divinyl sulfone, followed by refluxing with heating in nitrogen atmosphere for 6 hours. After distilling off the solvent 1-butanol under reduced pressure, the resulting residue was purified by silica gel column chromatography to yield 3.1 g of a light yellow crystal of Compound III-31. Its structure was determined by $^1H$ NMR, IR spectrometry and FD mass spectrometry.

The coupler of the invention is used normally in an amount of $1\times10^{-3}$ mole to 1 mole, and preferably $1\times10^{-2}$ mole to $8\times10^{-1}$ mole per mole of silver halide.

The coupler of the invention may be used in combination with different other cyan couplers.

The coupler of the invention may be used as a color photographic component material in any color-forming processes—a coupler-in-developer process and a coupler-in-emulsion process. In the coupler-in-developer process, the coupler of the invention dissolved in an alkaline aqueous solution or an organic solvent such as an alcohol, is added to a developer.

In the coupler-in-emulsion process, the coupler of the invention is incorporated into a photographic light-sensitive material.

In a typical manner, the coupler of the invention is incorporated into a silver halide emulsion, and the emulsion is coated on a support to form a color light-sensitive material. The coupler of the invention may be applied to any photographic light-sensitive materials such as color negative and positive films and a color photographic paper.

The light-sensitive materials in which the coupler of the invention is used may be of either monochrome or multicolor. In a multicolor light-sensitive material, the coupler of the invention is normally incorporated into a red-sensitive silver halide emulsion layer. The multicolor light-sensitive material comprises the dye image forming component layers spectrally sensitive to three primary color regions of the spectrum. Further, each light-sensitive layer comprises a single emulsion layer or a plurality of emulsion layers sensitive to the prescribed regions of the spectrum. The overall photographic component layers including the image-forming layers may be arranged in various orders. A typical multicolor light-sensitive material comprises a support having thereon a red-sensitive silver halide emulsion layer containing a cyan coupler, a green-sensitive silver halide emulsion layer containing a magenta coupler and a blue-sensitive silver halide emulsion layer containing a yellow coupler.

The light-sensitive material may also have other layers such as a filter layer, an intermediate layer, a protective layer and a subbing layer. The coupler of the invention is incorporated in accordance with known methods. For example, the couplers of the invention dissolved in high or low-boiling organic solvents are mixed with a gelatin aqueous solution containing a surface active agent, and after emulsifying by a high-speed rotary mixer or a colloid mill, silver halide was added, whereby the silver halide emulsion used in the invention is prepared.

The silver halides suitably usable for the light-sensitive material containing the coupler of the invention are silver chloride, silver chlorobromide and silver chloroiodobromide. A mixture of silver halides such as silver chloride plus silver bromide is also preferable. A silver halide emulsion used for a color photographic paper for which a particularly high-speed developability is required comprises preferably silver chloride, and more preferably silver chlorobromide or silver chloroiodobromide each containing at least 1% silver chloride.

The silver halide emulsion is chemically sensitized in usual manner, and also spectrally sensitized to a desired wavelength region.

The light-sensitive material containing the coupler of the invention may contain conventional additives such as an antistain agent, an antifoggant, a dye image stabilizer, a UV absorber, an antistatic agent, a matting agent and a surface active agent.

The photographic light-sensitive material comprising the coupler of the invention is subjected to color developing, bleaching and fixing. The bleaching and fixing may be performed simultaneously in a single bath.

After fixing, the light-sensitive material is normally subjected to washing. The washing may be replaced by stabilization or performed in combination therewith.

EXAMPLES

The invention is illustrated in detail by the following examples.

EXAMPLE 1

The following layers were coated in sequence on a polyethylene-laminated paper support, whereby the red-sensitive color light-sensitive material Sample 1 was prepared. The compounds used are indicated in amounts per $m^2$ unless otherwise stated, and silver halide is in silver equivalent.

Layer 1: Emulsion layer

A red-sensitive layer containing 1.2 g of gelatin, 0.30 g of a red-sensitive silver chlorobromide emulsion containing 96 mole % silver chloride, and $9.1\times10^{-4}$ mole of a comparative cyan coupler A dissolved in 1.35 g of dioctyl phosphate.

Layer 2: Protective layer

A protective layer containing 0.50 g of gelatin and sodium 2,4-dichloro-6-hydroxy-s-triazine as a hardening agent in an amount of 0.017 g per gram of the gelatin.

Next, Samples 2 to 15 of the invention and 16 for comparison were prepared in the same manner as in Sample 1 except that the comparative coupler A was replaced by the couplers given in Table 1 without changing the addition amount.

Each of Samples 1 to 16 was exposed through a wedge in the usual manner, and then processed in the following steps:

| Processing steps | | |
|---|---|---|
| Color developing | 38° C. | 3 min. 30 sec. |
| Bleach-fixing | 38° C. | 1 min. 30 sec. |
| Stabilizing | 25° C. to 30° C. | 3 min. |
| Drying | 75° C. to 80° C. | 2 min. |

The compositions of the processing solutions used in the above steps are as follows:

| | |
|---|---|
| Developer | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N-ethyl-N-(β-methanesulfonamidoethyl)-aniline sulfate | 5.5 g |
| Brightening agent, 4,4'-diaminostilbene-disulfonic acid derivative | 1.0 g |
| Potassium hydroxide | 2.0 g |
| Water to make 1 liter. Adjust pH to 10.20. | |
| Bleach-fixer | |
| Ferric-ammonium ethylenediaminetetra-acetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| Adjust pH to 7.1 with potassium carbonate or glacial acetic acid, and add water | |

-continued

| | |
|---|---|
| to make 1 liter. | |
| Stabilizer | |
| 5-Chloro-2-methyl-4-isothiazoline-3-one | 1.0 g |
| Ethylene glycol | 10 g |
| Water to make 1 liter. | |

Each of the processed Samples 1 to 16 was subjected to measurement of an initial density with a densitometer, and then allowed to stand over a period of 14 days under a high temperature/humidity condition (60° C./80% RH) for examination of the dye image's resistance to heat and moisture.

Each processed sample was exposed for 10 days to the light of a xenon fadeometer to measure light resistance. The results are given in Table 1. The heat/moisture resistance and the light resistance of the dye image are expressed in residual rates (%) of the dye after the resistance tests to the initial density of 1.0.

Comparative coupler A

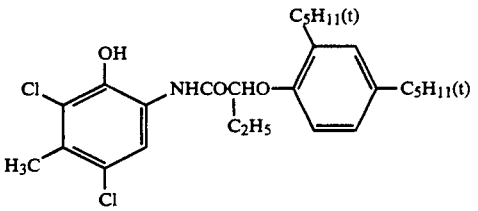

Comparative coupler B

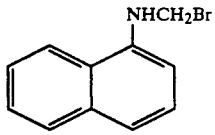

σp value: 0.12

TABLE 1

| Sample No. | Cyan coupler | Dye residual rate (%) Heat/moisture resistance | Light resistance |
|---|---|---|---|
| 1 | Comparative A | 59 | 81 |
| 2 | Invention I-2 | 89 | 84 |
| 3 | Invention I-6 | 91 | 87 |
| 4 | Invention I-11 | 87 | 80 |
| 5 | Invention I-13 | 85 | 82 |
| 6 | Invention II-2 | 93 | 81 |
| 7 | Invention II-11 | 90 | 79 |
| 8 | Invention II-23 | 89 | 79 |
| 9 | Invention III-3 | 84 | 84 |
| 10 | Invention III-5 | 86 | 85 |
| 11 | Invention III-7 | 85 | 84 |
| 12 | Invention III-8 | 89 | 87 |
| 12.1 | Invention III-21 | 90 | 86 |
| 12.2 | Invention III-29 | 91 | 88 |
| 12.3 | Invention III-37 | 90 | 88 |
| 12.4 | Invention III-42 | 92 | 86 |
| 13 | Invention IV-3 | 88 | 86 |
| 14 | Invention IV-6 | 88 | 87 |
| 15 | Invention V-3 | 84 | 80 |
| 16 | Comparative B | No color development | |
| 16.1 | Comparative D | No color development | |
| 16.2 | Comparative E | No color development | |

Comparative D

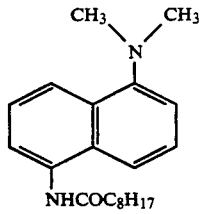

Compound of East German Patent No. 144130

Comparative E

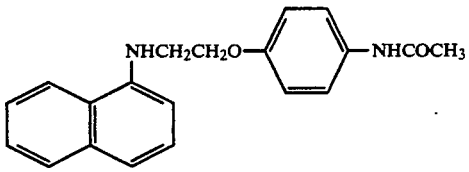

Compound of U.S. Pat. No. 2,389,575

Either Comparative Compound D or E, which are structurally similar to the compound of the invention, developed no color and could not be evaluated.

As is apparent from Table 1, the samples of the invention which contain the couplers of the invention have higher dye residual rates and more excellent resistance to heat, moisture and light than the sample containing the comparative coupler. Sample 16 containing comparative coupler B in which —$CH_2Br$ corresponding Y in Formula II has the σp value of 0.12 developed no color.

EXAMPLE 2

The following layers were coated in order on a subbed triacetate film base, whereby a red-sensitive color light-sensitive material Sample 17 was prepared. The compounds used are indicated in amounts per $m^2$, and silver halide is in silver equivalent.

Layer 1: Emulsion layer

A red-sensitive emulsion layer containing 1.4 g of gelatin, 1.5 g of a red-sensitive silver iodobromide emulsion containing 4 mole % silver iodide, and $8.0\times10^{-4}$ mole of a comparative cyan coupler C dissolved in 1.1 g of tricresyl phosphate.

Layer 2: Protective layer

A protective layer containing 1.5 g of gelatin and sodium 2,4-dichloro-6-hydroxy-s-triazine as a hardening agent in an amount of 0.017 g per gram of the gelatin.

Samples 18 to 31 of the invention were prepared in the same manner as Sample 17 except that the comparative coupler C was replaced by the couplers given in Table 2 without changing the addition amount.

Each of Samples 17 to 31 was exposed through a wedge in the usual manner, and then processed in the following steps.

Comparative coupler C

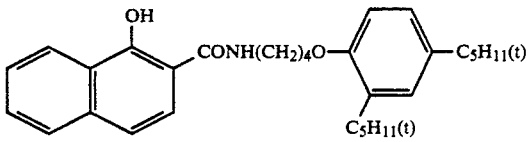

| Processing steps | | |
|---|---|---|
| Color developing | 38° C. | 3 min. 15 sec. |
| Bleaching | 38° C. | 6 min. 30 sec. |
| Washing | 25 to 30° C. | 3 min. 15 sec. |
| Fixing | 38° C. | 6 min. 30 sec. |
| Washing | 25 to 30° C. | 3 min. 15 sec. |
| Stabilizing | 25 to 30° C. | 1 min. 30 sec. |
| Drying | 75 to 80° C. | |

The compositions of the processing solutions used in the above steps are as follows:

| | |
|---|---|
| Color developer: | |
| 4-Amino-3-methyl-N-ethyl-N-(β-hydroxy-ethyl)-amiline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |
| Water to make 1 liter. | |
| Adjust pH to 10.6 with sodium hydroxide. | |
| Bleacher: | |
| Ferric-ammonium ethylenediaminetetraacetae | 100.0 g |
| Diammonium ethylenediaminetetraacetate | 10.0 g |
| Ammonium bromide | 150.0 g |
| Glacial acetic acid | 10.0 g |
| Water to make 1 liter. | |
| Adjust pH to 6.0 with ammonia water. | |
| Fixer: | |
| ammonium thiosulfate | 175.0 g |
| Anhydrous sodium sulfite | 8.6 g |
| Sodium metasulfite | 2.3 g |
| Water to make 1 liter. | |
| Adjust pH to 6.0 with acetic acid. | |
| Stabilizer: | |
| Formalin (37% by weight) | 1.5 ml |
| Koniducks (product of KONICA Corporation) | 7.5 ml |
| Water to make 1 liter. | |

Each of the processed Samples 17 to 31 was subjected to the resistance tests in the same manner as in Example 1. The results are shown in Table 2.

TABLE 2

| Sample No. | Cyan coupler | Dye residual rate (%) Heat/moisture resistance | Light resistance |
|---|---|---|---|
| 17 | Comparative C | 74 | 81 |
| 18 | Invention I-4 | 86 | 84 |
| 19 | Invention I-12 | 91 | 87 |
| 20 | Invention II-3 | 90 | 82 |
| 21 | Invention II-8 | 84 | 81 |
| 22 | Invention II-11 | 88 | 84 |
| 23 | Invention II-16 | 92 | 85 |
| 24 | Invention II-28 | 89 | 83 |
| 25 | Invention III-4 | 89 | 85 |
| 26 | Invention III-10 | 80 | 83 |
| 27 | Invention III-15 | 83 | 82 |
| 27.1 | Invention III-22 | 84 | 85 |
| 27.2 | Invention III-30 | 86 | 82 |
| 27.3 | Invention III-36 | 86 | 85 |
| 27.4 | Invention III-46 | 85 | 82 |
| 27.5 | Invention III-49 | 83 | 83 |
| 28 | Invention IV-5 | 85 | 82 |

TABLE 2-continued

| Sample No. | Cyan coupler | Dye residual rate (%) Heat/moisture resistance | Light resistance |
|---|---|---|---|
| 29 | Invention IV-9 | 84 | 84 |
| 30 | Invention IV-10 | 84 | 83 |
| 31 | Invention V-6 | 88 | 85 |
| 31.1 | Comparative F | No color development | |

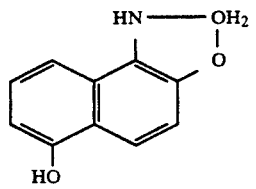

Comparative F

Compound of U.S. Pat. No. 2,394,527

Comparative Compound F, which is structurally similar to the compound of the invention, developed no color and could not be evaluated.

As is apparent from Table 2, the samples of the invention which contain the couplers of the invention have higher dye residual rates and more excellent resistance to heat, moisture and light than the sample containing the comparative coupler.

EXAMPLE 3

The following layers were coated in order on a triacetyl cellulose film support, whereby red-sensitive color reversal photographic light-sensitive material Samples 32 to 42 were prepared.

Layer 1: Emulsion layer

A red-sensitive emulsion layer containing 1.4 g of gelatin, 0.5 g of a red-sensitive silver chlorobromide emulsion containing 96 mole % silver chloride, and $9.1\times10^{-4}$ mole of a coupler given in Table 1 dissolved in 1.5 g of dibutyl phthalate.

Layer 2: Protective layer

A protective layer containing 0.5 g of gelatin and sodium 2,4-dichloro-6-hydroxy-s-triazine as a hardening agent in an amount of 0.017 g per gram of the gelatin

| Reversal processing steps | Time | Temperature |
|---|---|---|
| First developing | 6 minutes | 38° C. |
| Washing | 2 minutes | 38° C. |
| Reversal | 2 minutes | 38° C. |
| Color developing | 6 minutes | 38° C. |
| Compensating | 2 minutes | 38° C. |
| Bleaching | 6 minutes | 38° C. |
| Fixing | 4 minutes | 38° C. |
| Washing | 4 minutes | 38° C. |
| Stabilizing | 1 minute | 38° C. |
| Drying | | Room temperature |

The compositions of the processing solutions used are as follows:

| | |
|---|---|
| First developer | |
| Sodium tetrapolyphosphate | 2 g |
| Sodium sulfite | 20 g |
| Hydroquinone monosulfonate | 30 g |
| Sodium carbonate monohydrate | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml |
| Reversal solution | |
| Hexasodium nitrilotrimethylenephosphonate | 3 g |
| Stannous chloride dihydrate | 1 g |
| p-Aminophenol | 0.1 g |
| Sodium hydroxide | 5 g |
| Glacial acetic acid | 15 ml |
| Water to make | 1000 ml |
| Color developer | |
| Sodium tetrapolyphosphate | 2 g |
| Sodium sulfite | 7 g |
| Sodium tertiary phosphate dodecahydrate | 36 g |
| Potassium bromide | 1 g |
| Potassium iodide (0.1% solution) | 90 ml |
| Sodium hydroxide | 3 g |
| Citrazine acid | 1.5 g |
| N-ethyl-N-(β-methanesulfonamidoethyl)-3-methyl-4-aminoaniline sulfate | 11 g |
| Ethylenediamine | 3 g |
| Water to make | 1000 ml |
| Compensating solution | |
| Sodium sulfite | 12 g |
| Sodium ethylenediaminetetraacetate dihydrate | 8 g |
| thioglycerol | 0.4 ml |
| Glacial acetic acid | 3 ml |
| Water to make | 1000 ml |
| Bleacher | |
| Sodium ethylenediaminetetraacetate dihydrate | 2.0 g |
| Ferric-ammonium ethylenediaminetetraacetate dihydrate | 120.0 g |
| Potassium bromide | 100.0 g |
| Water to make | 1000 ml |
| Fixer | |
| Ammonium thiosulfate | 80.0 g |
| Sodium sulfite | 5.0 g |
| Sodium hydrogensulfite | 5.0 g |
| Water to make | 1000 ml |
| Stabilizer | |
| Formalin (37% by weight) | 5.0 ml |
| Koniducks (product of KONICA Corporation) | 5.0 ml |
| Water to make | 1000 ml |

Each processed sample was subjected to tests of heat/moisture and light resistance in the same manner as in Example 2. The results are shown in Table 3.

TABLE 3

| Sample No. | Cyan coupler | Dye residual rate (%) Heat/moisture resistance | Light resistance |
|---|---|---|---|
| 32 | Comparative A | 63 | 83 |
| 33 | Invention I-5 | 90 | 83 |
| 34 | Invention I-10 | 90 | 84 |
| 35 | Invention II-2 | 87 | 82 |
| 36 | Invention II-9 | 91 | 83 |
| 37 | Invention II-22 | 85 | 87 |
| 38 | Invention III-3 | 84 | 84 |

TABLE 3-continued

| Sample No. | Cyan coupler | Dye residual rate (%) Heat/moisture resistance | Light resistance |
|---|---|---|---|
| 39 | Invention III-8 | 89 | 84 |
| 40 | Invention III-20 | 84 | 83 |
| 40.1 | Invention III-23 | 88 | 82 |
| 40.2 | Invention III-24 | 89 | 82 |
| 40.3 | Invention III-32 | 86 | 84 |
| 40.4 | Invention III-40 | 89 | 84 |
| 40.5 | Invention III-48 | 85 | 82 |
| 41 | Invention IV-7 | 80 | 83 |
| 42 | Invention V-3 | 82 | 85 |
| 42.1 | Comparative G | No color development | |
| 42.2 | Comparative H | (52)*1 | (25)*1 |

Comparative G

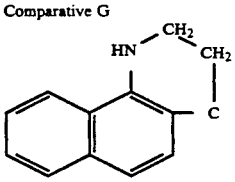

Compound of U.S. Pat. No. 2,362,519

Comparative H

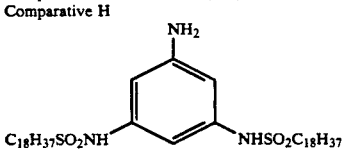

Compound of U.S. Pat. No. 2,569,906

Comparative Compound G, which is structurally similar to the compound of the invention, developed no color and could not be evaluated. Comparative Compound H developed a magenta color; it was evaluated with respect to heat stability, moisture resistance and light resistance by magenta dye concentration, and proved to be extremely low in fastness.

As is apparent from Table 3, the samples of the invention which contain the couplers of the invention have higher dye residual rates and more excellent resistance to heat, moisture and light than the sample containing the comparative coupler.

EXAMPLE 4

A multicolor film Sample 43 was prepared by coating the following component layers on a support having an antihalation layer.

Component layers . . . Pro layer, BH layer, BL layer, YF layer, GH layer, GL layer, IL layer, RH layer, RL layer, and support.

The above layers are explained.

RL layer: Low-speed red-sensitive silver halide emulsion layer containing 1.0 g of a red-sensitive AgBrI emulsion comprising Emulsion I having an average grain size ($\bar{r}$) of 0.47 μm, variation coefficient ($s/\bar{r}$) of 0.12 and an average AgI content of 8 mole %; 1.0 g of an AgBrI emulsion (Emulsion II) having an average grain size of 0.31 μm, a variation coefficient of 0.10 and an average AgI content of 8 mole %; and a dispersion prepared by dispersing in an aqueous solution of 2.4 g gelatin a solution of 0.07 g of disodium 1-hydroxy-4-[4-(1-hydroxy-8-acetamido-3,6-disulfo-2-naphthylazo)-phenoxy]-N-[δ-(2,4-di-t-amylphenoxy)butyl]-2-naphtoamide (CC-A), 0.4 g of 1-hydroxy-2-[δ-(2,4-di-t-amylphenoxy)-n-butyl]napthoamide (C-A) and 0.06 g of DIR compound D-1 each dissolved in 1.0 g of tricresyl phosphate (TCP).

RH layer: High-speed red-sensitive silver halide emulsion layer containing 2.0 g of a red-sensitive AgBrI emulsion comprising Emulsion III having an average grain size of 0.7 μm, a variation coefficient of 0.12 and an average AgI content of 6 mole %; and a dispersion prepared by dispersing in an aqueous solution of 1.2 g gelatin a solution of 0.20 g of a cyan coupler (C-A) and 0.03 g of a colored cyan coupler (CC-A) each dissolved in 0.23 g of TCP.

GL layer: Low-speed green-sensitive silver halide emulsion layer containing 1.5 g of green-sensitive Emulsion I; 1.5 g of green-sensitive Emulsion II; and a dispersion prepared by dispersing in an aqueous solution of 2.4 g gelatin a solution of 0.35 g of 1-(2,4,6-trichlorophenyl)-3-[3-(p-dodecyloxybenzenesulfonamido)benzamido)-5-pyrazolone (M-A), 0.10 g of 1-(2,4,6-trichlorophenyl)-4-(1-naphthylazo)-3-(2-chloro-5-octadecenylsuccinimidoanilino)-5-pyrazolone (CM-A) and 0.04 g of DIR compound D-1 each dissolved in 0.68 g of TCP.

GH layer: High-speed green-sensitive silver halide emulsion layer containing 2.0 g of green-sensitive Emulsion III; and a dispersion prepared by dispersing in an aqueous solution of 2.4 g gelain a solution of 0.14 g of magenta coupler M-A and 0.045 g of colored magenta coupler CM-A each dissolved in 0.27 g of TCP.

BL layer: Low-speed blue-sensitive silver halide emulsion layer containing 0.5 g of blue-sensitive Emulsion I; 0.5 g of blue-sensitive Emulsion II; and a dispersion prepared by dispersing in an aqueous solution of 1.8 g gelatin a solution of 0.7 g of α-pivaloyl-α-(1-benzyl-2-phenyl-3,5-dioxyimidazolidine-4-yl)-2-chloro-5-[α-dodecyloxycarbonyl)-ethoxycarbonyl]acetanilide (Y-A) and 0.02 g of DIR compound D-1 each dissolved in 0.68 g of TCP.

BH layer: High-speed blue-sensitive silver halide emulsion layer containing 0.9 g of a blue-sensitive AgBrI emulsion having an average grain size of 0.80 μm, a variation coefficient of 0.14 and an average AgI content of 6 mole %, and a dispersion prepared by dispersing in an aqueous solution of 2.0 g gelatin a solution of 0.25 g of yellow coupler Y-A dissolved in 0.25 g of TCP.

IL layer: Intermediate layer containing a solution of 0.07 g of 2,5-di-t-octylhydroquinone (HQ-1) dissolved in 0.07 g of dibutyl phthalate (DBP).

YF layer: Yellow filter layer containing 0.15 g of yellow colloidal silver; 0.2 g of HQ-1 (antistain agent) dissolved into 0.11 g of DBP; and 1.0 g of gelatin.

Pro layer: Protective layer containing 2.3 g of gelatin.

Samples 44 to 63 were prepared in the same manner as in Sample 43 except that C-A contained in the low-speed and high-speed red-sensitive silver halide emulsion layers of Sample 43 was replaced by the same molar amount of the couplers of the invention as shown in Table 4.

Each of Samples 43 to 63 was exposed through a wedge to a white light, and then processed in the same manner as in Example 2. The color density of each sample was measured through a red filter. The results are shown in Table 4.

DIR compound D-1

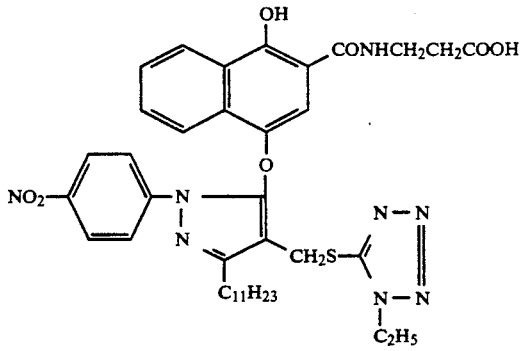

TABLE 4

| Sample No. | Cyan coupler | Fog (D min) | Relative sensitivity |
|---|---|---|---|
| 43 | C-A (Comparative) | 0.10 | 100 |
| 44 | I-2 (Invention) | 0.09 | 121 |
| 45 | I-7 (Invention) | 0.10 | 119 |
| 46 | I-4 (Invention) | 0.11 | 130 |
| 47 | II-4 (Invention) | 0.08 | 128 |
| 48 | II-8 (Invention) | 0.09 | 124 |
| 49 | II-12 (Invention) | 0.09 | 125 |
| 50 | II-14 (Invention) | 0.10 | 122 |
| 51 | II-16 (Invention) | 0.08 | 121 |
| 52 | II-23 (Invention) | 0.11 | 126 |
| 53 | II-27 (Invention) | 0.08 | 125 |
| 54 | III-3 (Invention) | 0.12 | 110 |
| 55 | III-4 (Invention) | 0.09 | 129 |
| 56 | III-6 (Invention) | 0.11 | 115 |
| 57 | III-7 (Invention) | 0.10 | 122 |
| 58 | III-8 (Invention) | 0.12 | 133 |
| 59 | III-9 (Invention) | 0.09 | 136 |
| 59.1 | III-25 (Invention) | 0.09 | 121 |
| 59.2 | III-26 (Invention) | 0.10 | 126 |
| 59.3 | III-29 (Invention) | 0.09 | 135 |
| 59.4 | III-31 (Invention) | 0.11 | 141 |
| 59.5 | III-36 (Invention) | 0.10 | 139 |
| 59.6 | III-44 (Invention) | 0.12 | 144 |
| 60 | IV-3 (Invention) | 0.09 | 121 |
| 61 | IV-8 (Invention) | 0.11 | 130 |
| 62 | V-2 (Invention) | 0.09 | 122 |
| 63 | V-8 (Invention) | 0.08 | 124 |
| 63.1 | I (Comparative) | 0.09 | 0.10 |

Comparative I

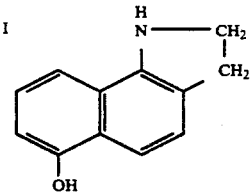

Compound of U.S. Pat. No. 2,394,527

Comparative Compound I, which is structurally similar to the compound of the present invention, was found to develop almost no color.

As is apparent from Table 4, samples 44 to 63 containing the couplers of the invention show much higher relative sensitivities than that of Sample 43 containing the conventional cyan coupler, while they have almost equal fog.

What is claimed is:

1. A silver halide photographic light-sensitive material comprising a support and provided thereon photographic component layers including a silver halide emulsion layer containing at least one cyan coupler represented by the following Formula III:

Formula III

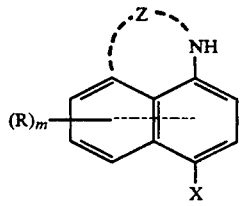

wherein R represents a substituent; Z represents the group of nonmetallic atoms necessary to form a 5 to 7-membered nitrogen-containing heterocyclic ring comprising a following unit connected to the —NH— shown in the Formula III:

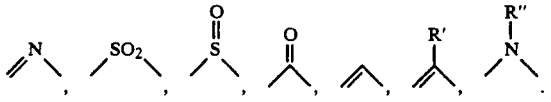

wherein R′ and R″ each represent the same substituents as those defined for R, provided that the group may contain two or more units;

m represents an integer of 0 to 5; each R may be the same or different; and X represents a hydrogen atom or a substituent capable of splitting off upon a reaction with an oxidation product of a developing agent.

2. The material of claim 1, wherein R represents an alkyl group, a carboxyl group, an oxycarboxyl group, a cyano group, a hydroxy group, an alkoxy group, an aryloxy group, an amino group, an amide group, a sulfonamide group, or a halogen atom.

3. The light-sensitive material of claim 2, wherein R's of $(R)_m$ combine with each other to form a 5 to 8-membered heterocyclic ring when or m is 2 or more.

4. The light-sensitive material of claim 1, containing said cyan coupler in an amount of $1\times10^{-3}$ to 1 mol per mol of silver halide.

5. The light-sensitive material of claim 4, wherein said amount is $1\times10^{-2}$ to $8\times10^{-1}$ mol of silver halide.

6. The light-sensitive material of claim 1, wherein said silver halide emulsion comprises at least one of silver chloride, silver chlorobromide and silver chlorobromoidide.

7. The light-sensitive material of claim 1, wherein R's of $(R)_m$ combine with each other to form a 5 to 8-membered heterocyclic ring when l or m is 2 or more.

* * * * *